US006233758B1

(12) United States Patent
Jeong

(10) Patent No.: US 6,233,758 B1
(45) Date of Patent: May 22, 2001

(54) WATER SAVING MECHANISM FOR SHOWER DEVICE

(75) Inventor: Ji-Hang Jeong, Taejeon (KR)

(73) Assignee: Dae Yong Co., Ltd., Taejeon (KR)

( * ) Notice: Subject to any disclaimer, the term of this patent is extended or adjusted under 35 U.S.C. 154(b) by 0 days.

(21) Appl. No.: 09/392,249

(22) Filed: Sep. 9, 1999

(30) Foreign Application Priority Data

Sep. 9, 1998 (KR) ..... 98-37060

(51) Int. Cl.[7] ..... A47K 3/28; B05B 1/02

(52) U.S. Cl. ..... 4/615; 137/39; 137/901; 239/569; 239/571

(58) Field of Search ..... 4/615; 239/525, 239/530, 569, 570, 571; 137/39, 38, DIG. 901; 251/16

(56) References Cited

U.S. PATENT DOCUMENTS

| | | | | |
|---|---|---|---|---|
| 4,614,303 | | 9/1986 | Moseley, Jr. et al. . | |
| 4,903,897 | * | 2/1990 | Hayes | 239/525 X |
| 5,260,918 | | 11/1993 | Neustein et al. . | |
| 5,293,654 | | 3/1994 | Castwall et al. . | |
| 5,360,172 | * | 11/1994 | Wang | 239/530 X |
| 5,511,763 | | 4/1996 | Green . | |
| 5,620,022 | * | 4/1997 | Manoogian | 137/39 X |

FOREIGN PATENT DOCUMENTS

| | | | | |
|---|---|---|---|---|
| 3726788 | * | 2/1989 | (DE) | 4/615 |
| 09273646 | * | 10/1997 | (JP) . | |

* cited by examiner

*Primary Examiner*—Gregory L. Huson
*Assistant Examiner*—Kathleen J. Prunner
(74) *Attorney, Agent, or Firm*—Shanks & Herbert

(57) ABSTRACT

A water saving mechanism is assembled with a shower device and is simply constructed in such a manner that supply of water is executed by the pressing of a push member and discharge of water is cut by the inclination of a shower head in a downward direction. The water saving mechanism for the shower device includes: a ball valve taking a ball shape; a body having a valve space into which the ball valve is inserted and having an exit hole on the one side thereof, the exit hole having a smaller diameter than the ball valve; a ball valve moving member adapted to be coupled to the valve space in the direction opposite to the exit hole of the body and having a moving hole into which the ball valve is movably inserted on the interior thereof to thereby limit the moving range of the ball valve; and an operating member adapted to be assembled to be movable forwardly/backwardly in a radial direction on the one side of the peripheral surface of the body and/or the ball valve moving member and for moving the ball valve towards the ball valve moving member by the advancement to the exit hole of the body.

9 Claims, 7 Drawing Sheets

WATER SAVING MECHANISM FOR SHOWER DEVICE

BACKGROUND OF THE INVENTION (a) Field of the Invention

The present invention relates to a water saving mechanism for a shower device which is assembled with the shower device and is simply constructed, by using a ball valve, in such a manner that supply of water is executed by the pressing of a push member and discharge of water is stopped by the inclination of a shower head in a downward direction.

(b) Description of Related Art

Generally, a shower device, which is connected to a tap via a hose, is used to spray water like a fountain. The shower device is comprised of a shower hose having a predetermined length and branched to be connected from the tap and a shower head installed on the end portion of the shower hose and adapted to be grasped by a user's hand, for spraying water therefrom.

A conventional shower device is constructed in such a manner that as water flowing is selected at a tap side, the water flows to the tap and the shower device, and a valve handle grip, which is connected to a valve device, is installed at the tap side to determine whether the discharge of water is executed.

Under the construction of the conventional shower device, however, in the case where the user takes a shower at the state where the shower head is fixed at a predetermined height, he should bend his back to operate the valve handle grip installed on the tap side, so as to cut the discharge of water from the tap side.

Therefore, most of users should have a shower in the state where the water is continually discharged.

However, from environmental and economical points of view, the conventional shower device contains some problems to be solved. Recently, with the activation of campaigns for water saving or protection of the natural environment, there have been developed various kinds of water saving mechanisms or equipments.

Unfortunately, on the other hand, the water saving structure which is adapted to the conventional shower device has the following disadvantages: firstly, it is constructed in a complex manner; secondly, it is expensive; and thirdly, it often gets out of order.

Moreover, since the conventional water saving structure can not be applicable to the existing shower device, there is an inconvenience that the existing shower device already installed and used should be exchanged into a new one so as to introduce the water saving structure.

SUMMARY OF THE INVENTION

Accordingly, the present invention is directed to a water saving mechanism for a shower device that substantially obviates one or more of the problems due to limitations and disadvantages of the related arts.

An object of the invention is to provide a water saving mechanism for a shower device which can be applicable to an existing shower device which has been already installed and used as well as a new shower device which is newly manufactured.

Another object of the invention is to provide a water saving mechanism for a shower device which can be simply constructed, by using a ball valve, in such a manner that supply of water is executed by the pressing of a push member and discharge of water is cut by the inclination of a shower head in a downward direction.

Still another object of the invention is to provide a shower head including a water saving mechanism which can be simply constructed, by using a ball valve, in such a manner that supply of water is executed by the pressing of a push member and discharge of water is cut by the inclination of a shower head in a downward direction.

According to an aspect of the present invention, there is provided a water saving mechanism for a shower device comprising: a ball valve taking a ball shape; a body having a valve space into which the ball valve is inserted and having an exit hole on the one side thereof, the exit hole having a smaller diameter than the ball valve; a ball valve moving member adapted to be coupled to the valve space in the direction opposite to the exit hole of the body and having a moving hole into which the ball valve is movably inserted on the interior thereof to thereby limit the moving range of the ball valve; and an operating member adapted to be assembled to be movable forwardly/backwardly in a radial direction on the one side of the peripheral surface of the body and/or the ball valve moving member and for moving the ball valve towards the ball valve moving member by the advancement to the exit hole of the body.

The water saving mechanism for the shower device according to the present invention further comprises a push member which is installed to be movable forwardly/backwardly in a moving direction of the operating member, on the outer peripheral surface of the body and is securely connected to the end portion of the outside of the operating member.

Preferably, the water saving mechanism for the shower device according to the present invention further comprises an elastic member which is installed between the push member and the body and applies an elastic force in a reverse direction to the push member and/or the operating member.

A female screw, which is adapted to be connected to the shower head, is formed on the outside of the exit hole of the body, and a male screw, which is adapted to be connected to the shower hose or to assemble a connecting member connected to the shower hose, is formed on the outer peripheral surface of the valve space of the body.

According to another aspect of the present invention, there is provided a shower head including a water saving mechanism comprising: a first head body having a connecting part connected to a shower hose on the one end portion thereof; a second head body adapted to be assembled with the first head body and having a passage and an assembling space in the interior thereof and a plurality of spray holes formed on the end portion opposite to the connecting part of the first head body; a ball valve taking a ball shape; a body adapted to be inserted into the assembling space formed by means of the first and second head bodies and having a valve space into which the ball valve is inserted and having an exit hole on the one side thereof, the exit hole having a smaller diameter than the ball valve; a ball valve moving member adapted to be coupled to the valve space in the direction opposite to the exit hole of the body and having a moving hole into which the ball valve is movably inserted on the interior thereof to thereby limit the moving range of the ball valve; and an operating member adapted to be assembled to be movable forwardly backwardly in a radial direction of the exit hole of the body on the one side of the peripheral surface of the body and by passing the first head body or the second head body and for moving the ball valve towards the ball valve moving member by the advancement to the exit hole of the body.

The shower head including the water saving mechanism according to the present invention further comprises a push member which is installed to be movable forwardly/backwardly in a moving direction of the operating member, on the outer peripheral surface of the first head body or the second head body and is securely connected to the end portion of the outside of the operating member.

The shower head including the water saving mechanism according to the present invention further comprises an elastic member which is installed between the push member and the first head body or the second head body and applies an elastic force in a reverse direction to the push member and/or the operating member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENT

Reference will now be made in detail to the preferred embodiments of the present invention, examples of which are illustrated in the accompanying drawings.

Figure 1:
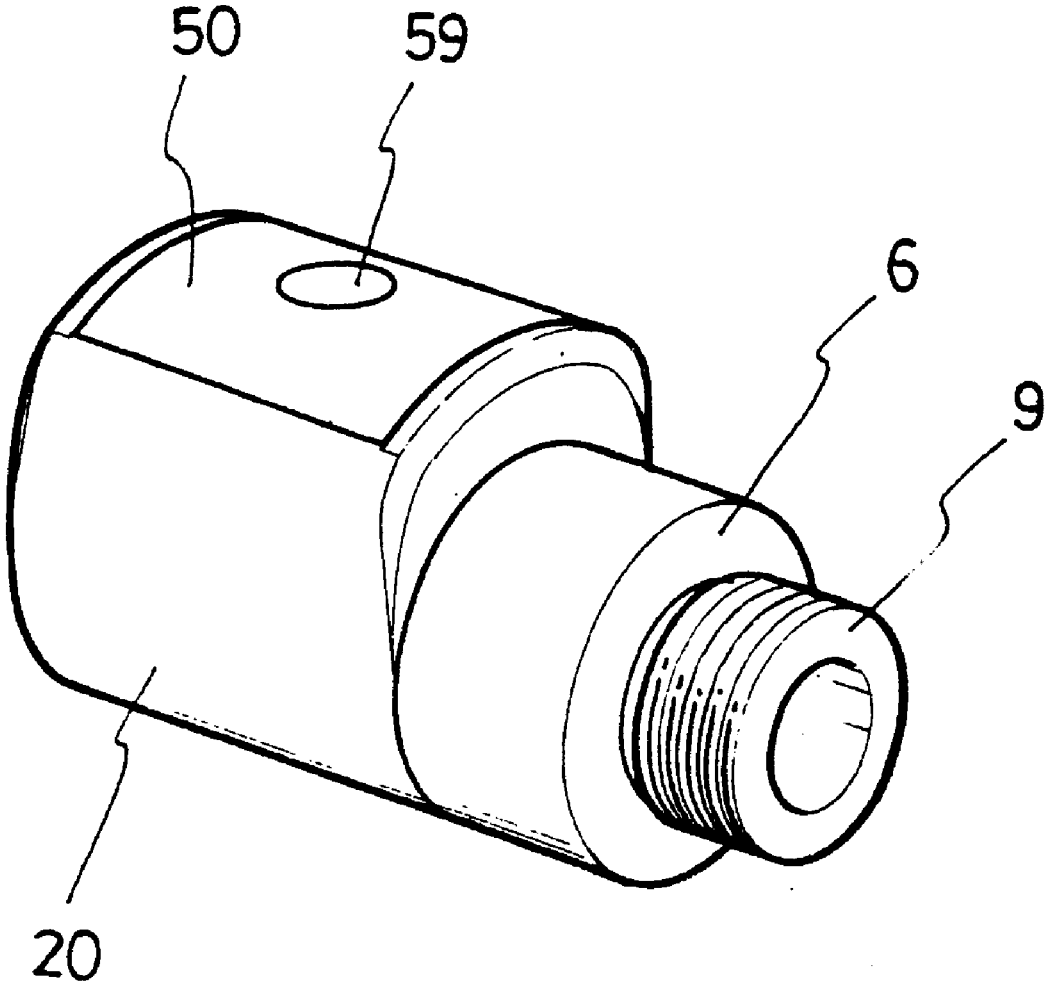
FIG. 1 is a perspective view illustrating a water saving mechanism for a shower device according to a preferred embodiment of the present invention.
Figure 2:
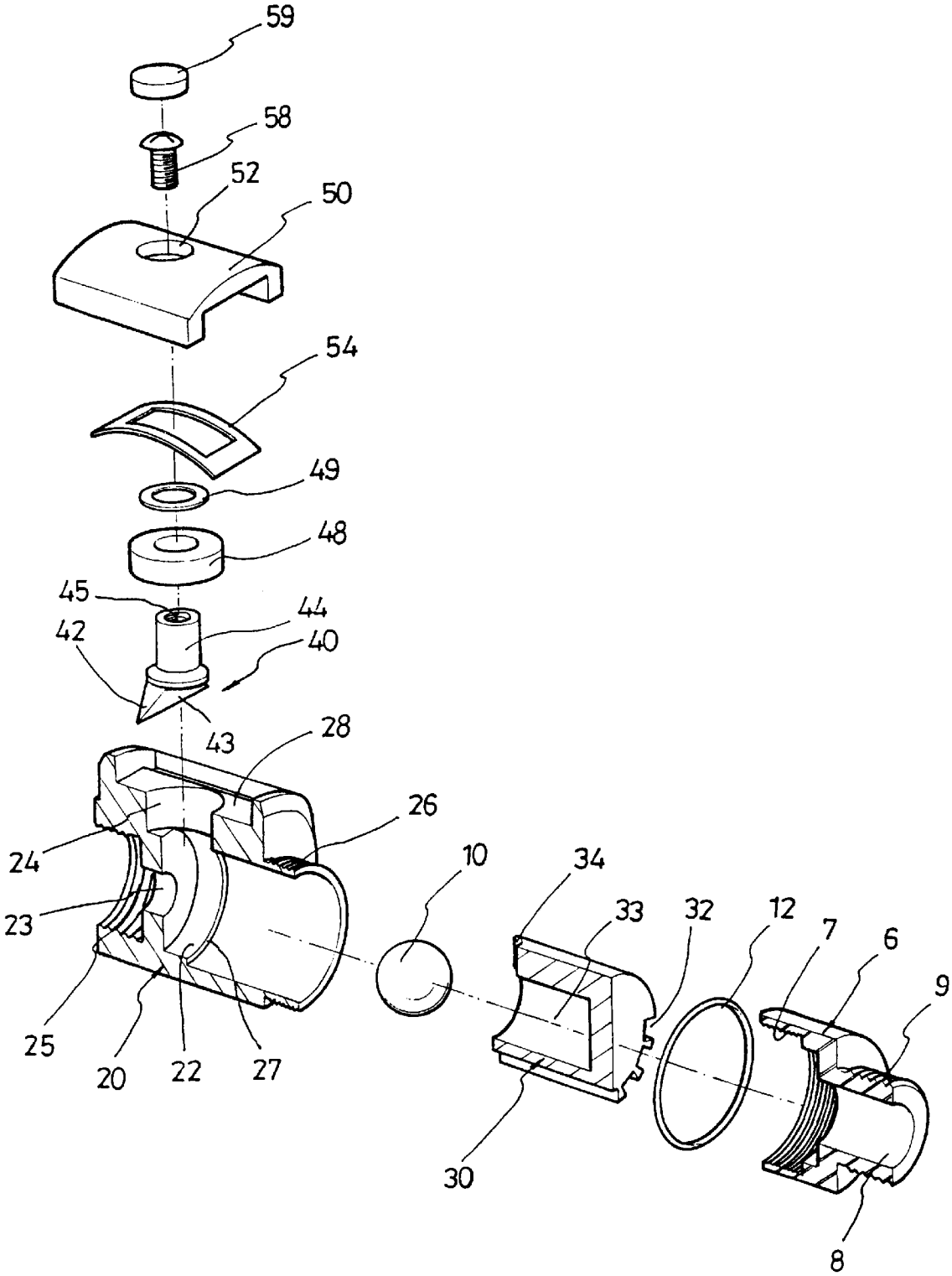
FIG. 2 is an exploded perspective view of FIG. 1.
Figure 3:
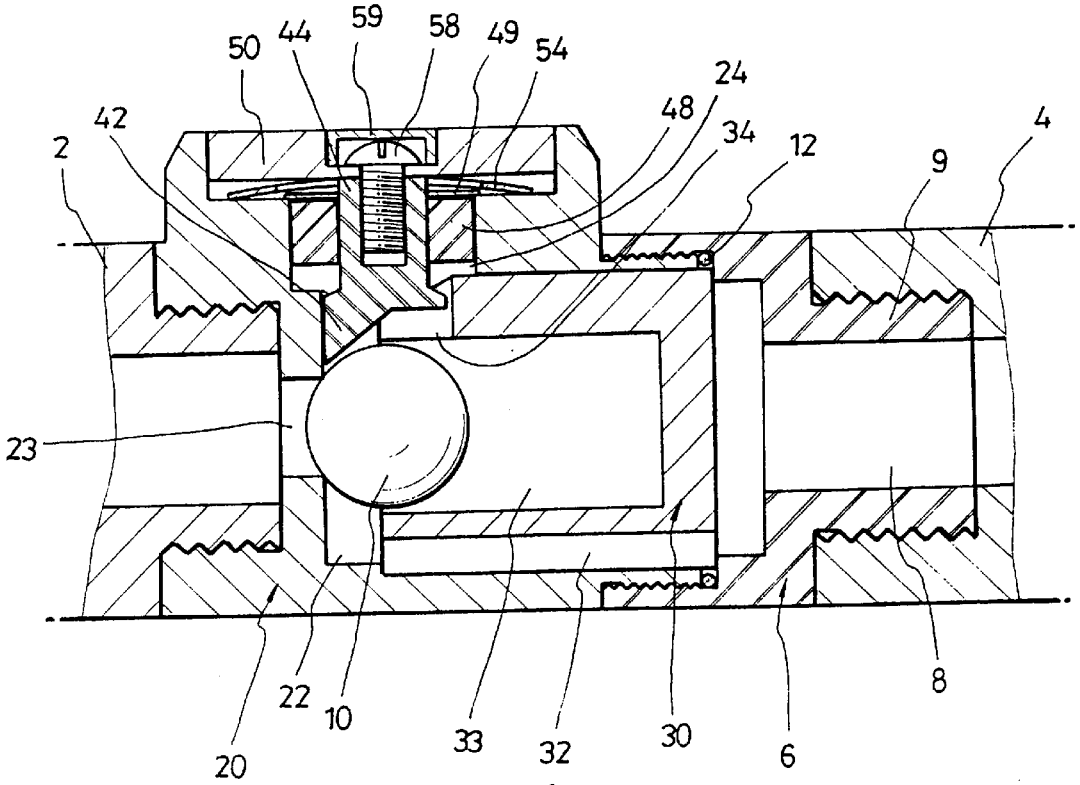
FIG. 3 is an assembled sectional view illustrating a state prior to operation in FIG. 1.

FIGS. 1 to 3 show a water saving mechanism for a shower device according to a preferred embodiment of the present invention.

In construction, the water saving mechanism includes: a ball valve 10 taking a ball shape; a body 20 having a valve space 22 into which the ball valve 10 is inserted and having an exit hole 23 on the one side thereof, the exit hole 23 having a smaller diameter than the ball valve 10; a ball valve moving member 30 adapted to be coupled to the valve space 22 in the direction opposite to the exit hole 23 of the body 20 and having a moving hole 33 into which the ball valve 10 is movably inserted on the interior thereof to thereby limit the moving range of the ball valve 10; and an operating member 40 adapted to be assembled to be movable forwardly/backwardly in a radial direction on the one side of the peripheral surface of the body 20 and/or the ball valve moving member 30 and for moving the ball valve 10 towards the ball valve moving member 30 by the advancement to the exit hole 23 of the body 20.

Figure 5:
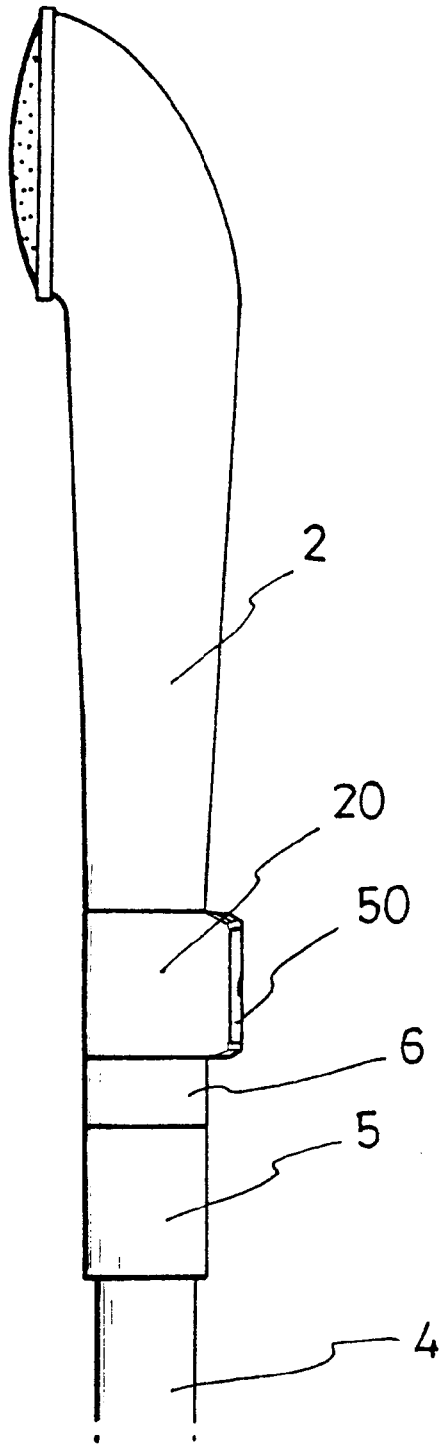
FIG. 5 is a side view illustrating an assembled state of the water saving mechanism according to the preferred embodiment of the present invention between a shower head and a shower hose.

A female screw 25, as shown in FIGS. 2 and 5, which is adapted to be connected to a shower head 2, is formed on the outside of the exit hole 23 of the body 20.

A male screw 26, as shown in FIGS. 2 and 5, which is adapted to be connected to a shower hose 4 or to assemble a connecting member 6 connected to the shower hose 4, is formed on the outer peripheral surface of the valve space 22 of the body 20.

As shown in FIGS. 2 and 5, a female screw 7, which is adapted to be screw-coupled to the male screw 26 formed on the body 20, is formed on the one side of the connecting member 6, and a male screw 9, which is adapted to be screw-coupled to a female formed on a connecting part 5 of the shower hose 4, on the outer peripheral surface opposite to the one side of the connecting member 6.

An O-ring 12, preferably, which is inserted into a screw-coupled portion of the body 20 and the connecting member 6, serves to prevent the water flowing through a passage 8 of the connecting member 6 from being leaked to the outside.

The passage 8 is installed in the interior of the connecting member 6 to connect the shower hose 4 and the valve space 22 of the body 20.

It is preferable that the contacted surface of the exit hole 23 of the body 20 with the ball valve 10 should take a spherical shape to be smoothly contacted with the ball valve 10.

On the outer peripheral surface of the ball valve moving member 30, as shown in FIG. 2, is provided one or more guide grooves 32 which serve to guide the water flowing through the shower hose 4 and/or the passage 8 of the connecting member 6 to the valve space 22 of the body 20.

Preferably, the guide groove 32 is formed to have a predetermined depth to be sufficiently connected to the valve space 22.

An operating groove 34, which is passed through the moving hole 33 and becomes a moving space of the operating member 40, is formed on the end portion of the one side of the ball valve moving member 30 which is contacted with the valve space 22 of the body 20.

The moving hole 33 in the interior of the ball valve moving member 30 is inclined to smoothly move the ball valve 10 in a horizontal state to the exit hole 23 of the body 20, by tare of the ball valve 10.

In more detail, the moving hole 33 is formed to reduce the diameter thereof from an inlet(toward the exit hole 23) to an inside(opposite to the exit hole 23).

The moving hole 33 in the interior of the ball valve moving member 30 is formed to be blocked on the opposite side to the exit hole 23 of the body 20.

As shown in FIG. 2, the body 20 is provided with a locking projection 27 which is separated by a predetermined distance from the exit hole 23 to lock the end of the ball valve moving member 30, to thereby form the predetermined valve space 22.

On the one side of the outer peripheral surface of the body 20, as shown in FIGS. 2 and 3, there is provided an operating hole 24 in open communication with the valve space 22 and into which the operating member 40 is inserted and moved.

The operating member 40, as shown in FIGS. 2 and 3, includes: an operating body 42 having an inclined surface 43 contacted with the ball valve 10; and a supporting body 44 connected with the operating body 42 and extended to the outside of the body 20.

The operating body 42 has a roughly triangled section, in which the end thereof becomes gradually sharp but the outside thereof becomes gradually enlarged toward the ball valve moving member 30.

The water saving mechanism for the shower device according to the present invention further comprises, as shown in FIGS. 1 to 3, a push member 50 which is installed to be movable forwardly/backwardly in a moving direction of the operating member 40, on the outer peripheral surface of the body 20 and is securely connected to the supporting body 44 on the end portion of the outside of the operating member 40.

Preferably, the water saving mechanism for the shower device according to the present invention further comprises, as shown in FIGS. 1 to 3, an elastic member 54 which is installed between the push member 50 and the body 20 and applies an elastic force in a reverse direction to the push member 50 and/or the operating member 40.

The body 20 is provided with a push groove 28 into which the push member 50 is movably inserted, thus to be connected to the operating hole 24.

Female screw threads 45 are formed on the end portion of the supporting body 44 of the operating member 40, and a set screw 58 is formed to be inserted into the push member 50 on which a fixed hole 52 is formed to lock the head portion of the set screw 58.

The set screw 58 is screw-coupled on the female screw threads 45 of the operating member 40 through the fixed hole 52 from the outside of the push member 50, such that the operating member 40 is secured to be integrated with the push member 50.

The supporting body 44 of the operating member 40 is provided with a packing 48 which serves to seal the clearance formed between the body 20 and the operating hole 24 to thereby prevent the water in the valve space 22 from being leaked to the outside.

A washer 49 is inserted between the packing 48 and the push member 50 and then the setscrew 58 is screw-coupled to the female screw threads 45 of the operating member 40.

Preferably, a cover 59, which is formed on the push member 50, serves to protect the set screw 58 which is screw-coupled to the operating member 40 and to cover the set screw 58 from the outside.

Preferably, the elastic member 54 is formed by a plate spring.

Of course, the elastic member 54 may be formed by a coil spring or any type of elastic body which can apply an elastic force in a reverse direction to the push member 50 and/or the operating member 40.

Next, an explanation of an operation of the water saving mechanism in the shower device according to the preferred embodiment of the present invention will be discussed hereinafter.

Figure 4:
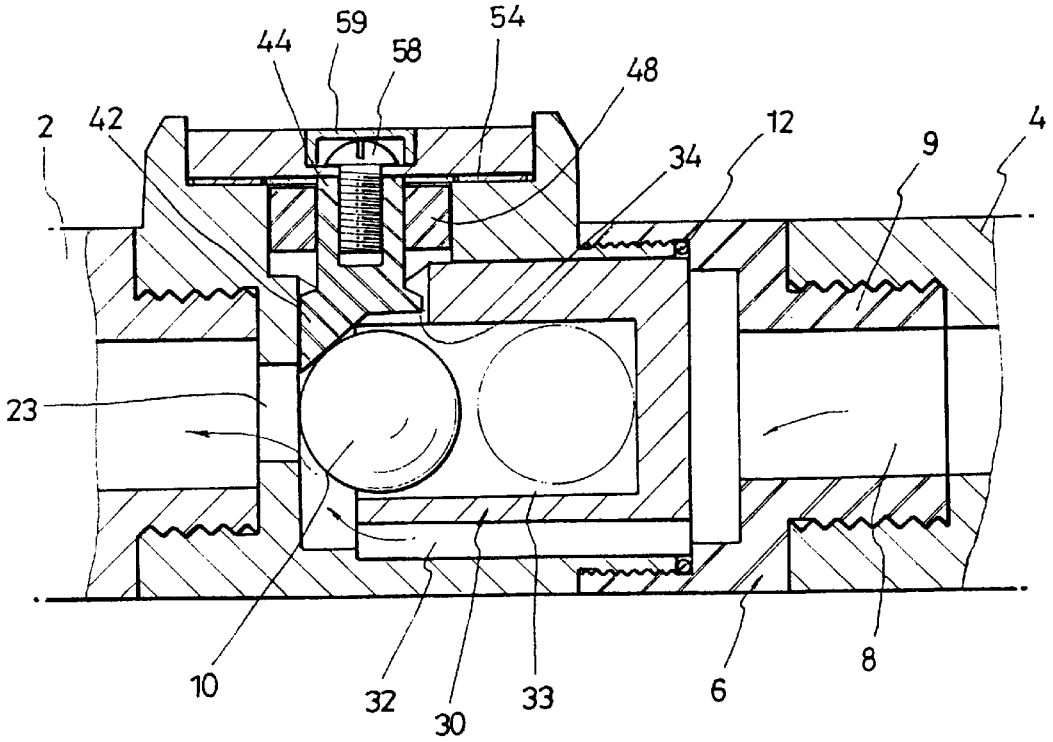
FIG. 4 is an assembled sectional view illustrating a state after operation in FIG. 1.

Firstly, the water saving mechanism in the shower device of the present invention is connected between the shower head 2 and the shower hose 4 and the valve handle grip of the tap is operated in the state where the end portion of the shower head 2 is lifted upwardly, to thus execute supply of water to the shower head 2. Under the above state, the ball valve 10 moves in the inside of the moving hole 33 of the ball valve moving member 30 by the tare thereof and is separated from the exit hole 23 of the body 20. As a result, the water supplied through the shower hose 4 and the passage 8 of the connecting member 6 is passed through the valve space 22 and the exit hole 23 of the body 20 via the guide groove 32 of the ball valve moving member 30 to be finally supplied to the shower head 2(see the two-dots and broken line position of the ball valve shown in FIG. 4).

If the discharge of water for a short time period is to be stopped during the supply of water to the shower head 2, the shower head 2 is fixed in a horizontal direction or the end portion thereof falls in a downward direction.

If the shower head 2 is fixed in the above direction, the ball valve 10 moves along the moving hole 33 of the ball valve moving member 30 which is inclined by means of the operation of the tare thereof and thus blocks the exit hole 23 of the body 20.

Under the state where the exit hole 23 is blocked by the ball valve 10, the water supplied through the guide groove 32 of the ball valve moving member 30 charges the valve space 22 of the body 20 and the moving hole 33 of the ball valve moving member 30. In the above state, as the ball valve 10 is in close contact with the exit hole 23 by the water pressure supplied from the tap, the supply of water to the shower head 2 is stopped, as shown in FIG. 3.

In the state where the ball valve 10 is in close contact with the exit hole 23 by the water pressure supplied from the tap, even though the shower head 2 is erected vertically, the water can not be sprayed through the shower head 2 since the tare of the ball valve 10 is greater than the water pressure applied.

If the water is to be re-used under the above state, the push member 50 is pressed by a user in the state where the shower head 2 is placed upwardly on the end portion thereof.

When the push member 50 is pressed, the operating member 40 formed to be integrated with the push member 50 advances toward the ball valve 10, and the inclined surface 43 of the operating body 42 of the operating member 40 is in contact with the ball valve 10. As a result, the ball valve 10 is separated from the exit hole 23 by means of the operation of the inclined surface 43 like a wedge on the operating member 40.

Under the above state, the water charged into the valve space 22 of the body 20 is passed through the exit hole 23 to be supplied to the shower head 2, and the ball valve 10 is moved to the inside of the moving hole 33 of the ball valve moving member 30 by the tare thereof.

If the force applied to the push member 50 is removed under the above state, the push member 50 and the operating member 40 are moved backwardly(outside) by the elastic force of the elastic member 54.

Since the pressure of water applied is continually maintained through the exit hole 23 under the above state, it has no influence on the ball valve 10 and the supply of water to the shower head 2 is continually executed unless the shower head 2 is bent in the horizontal or downward direction.

It is preferable that the ball valve 10 should have a relative heavy tare in the range lower than the pressure of water.

Figure 6:
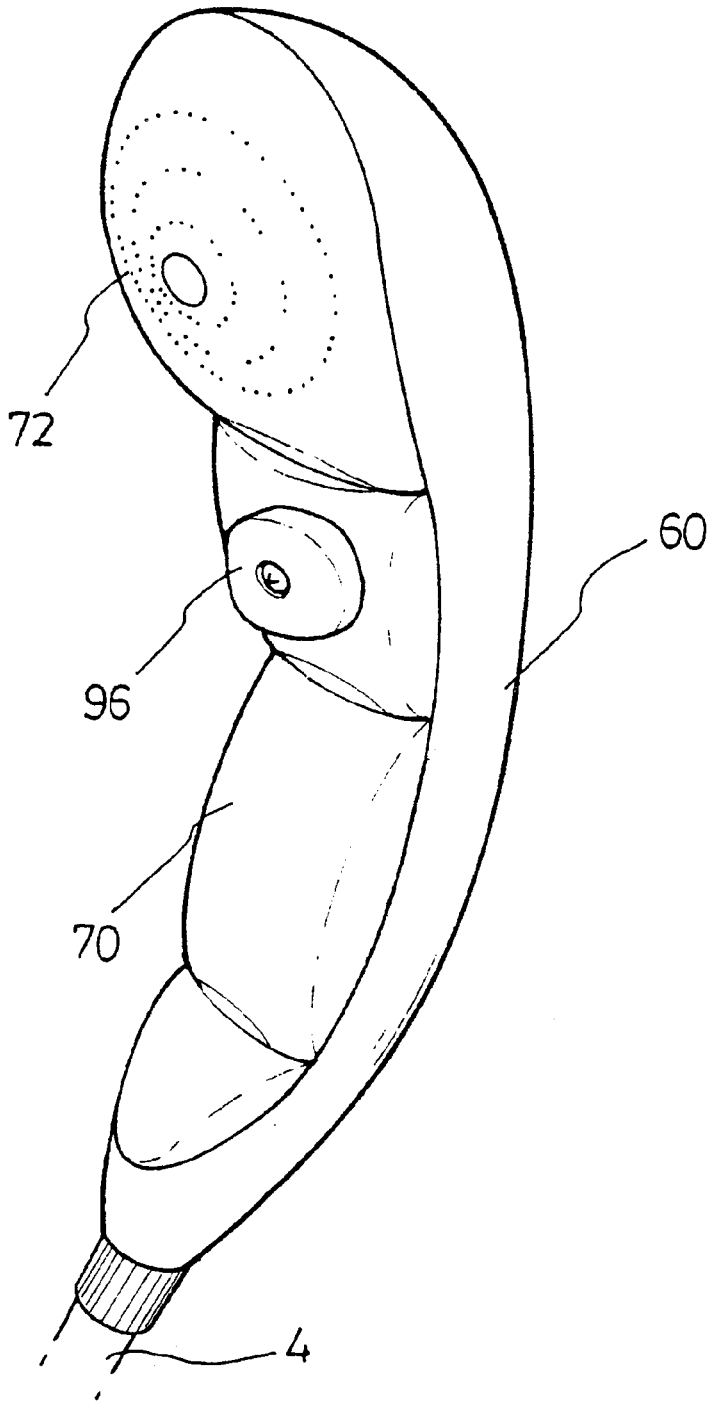
FIG. 6 is a perspective view illustrating a shower head including a water saving mechanism according to a preferred embodiment of the present invention.
Figure 7:
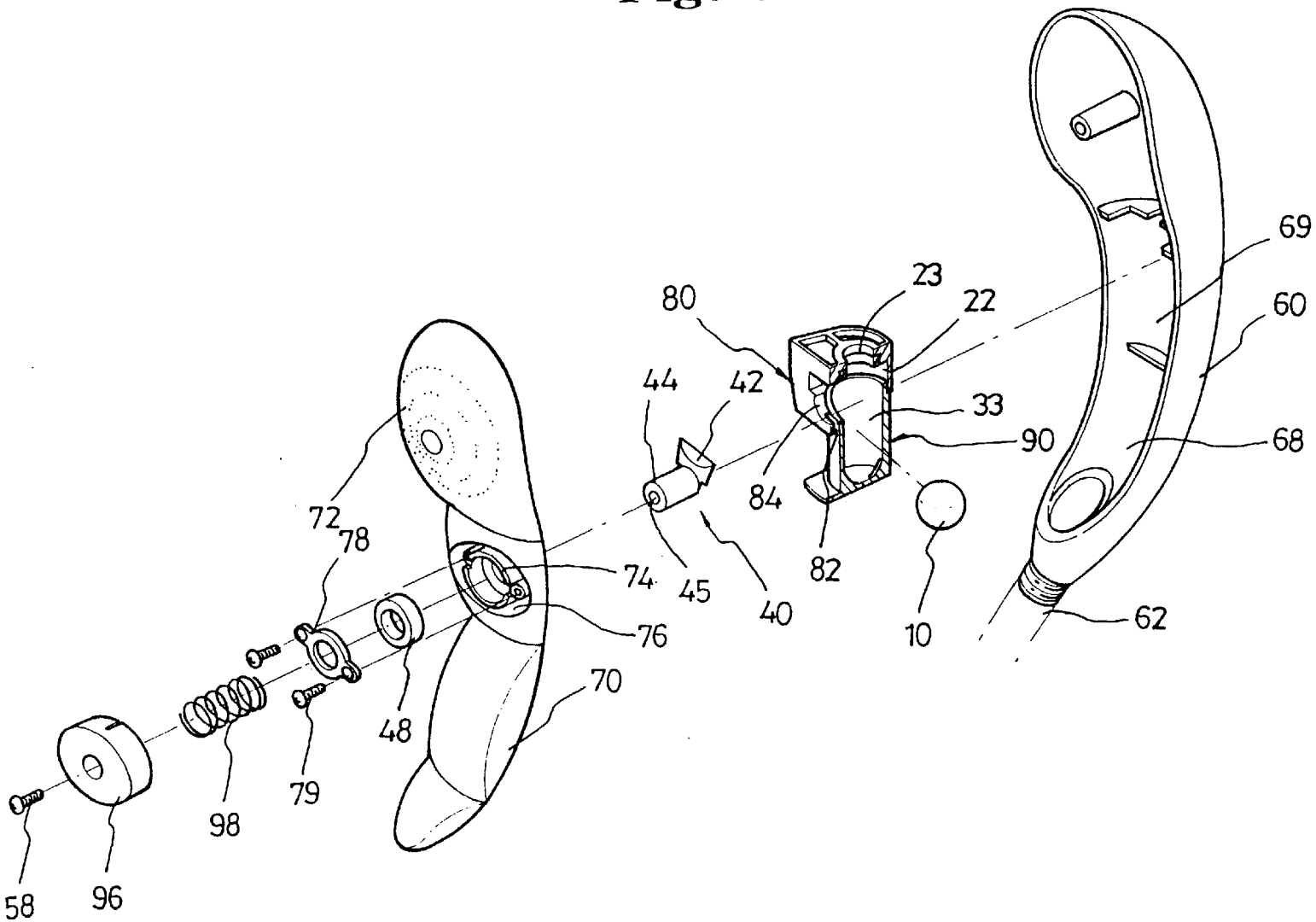
FIG. 7 is an exploded perspective view of FIG. 6.
Figure 8:
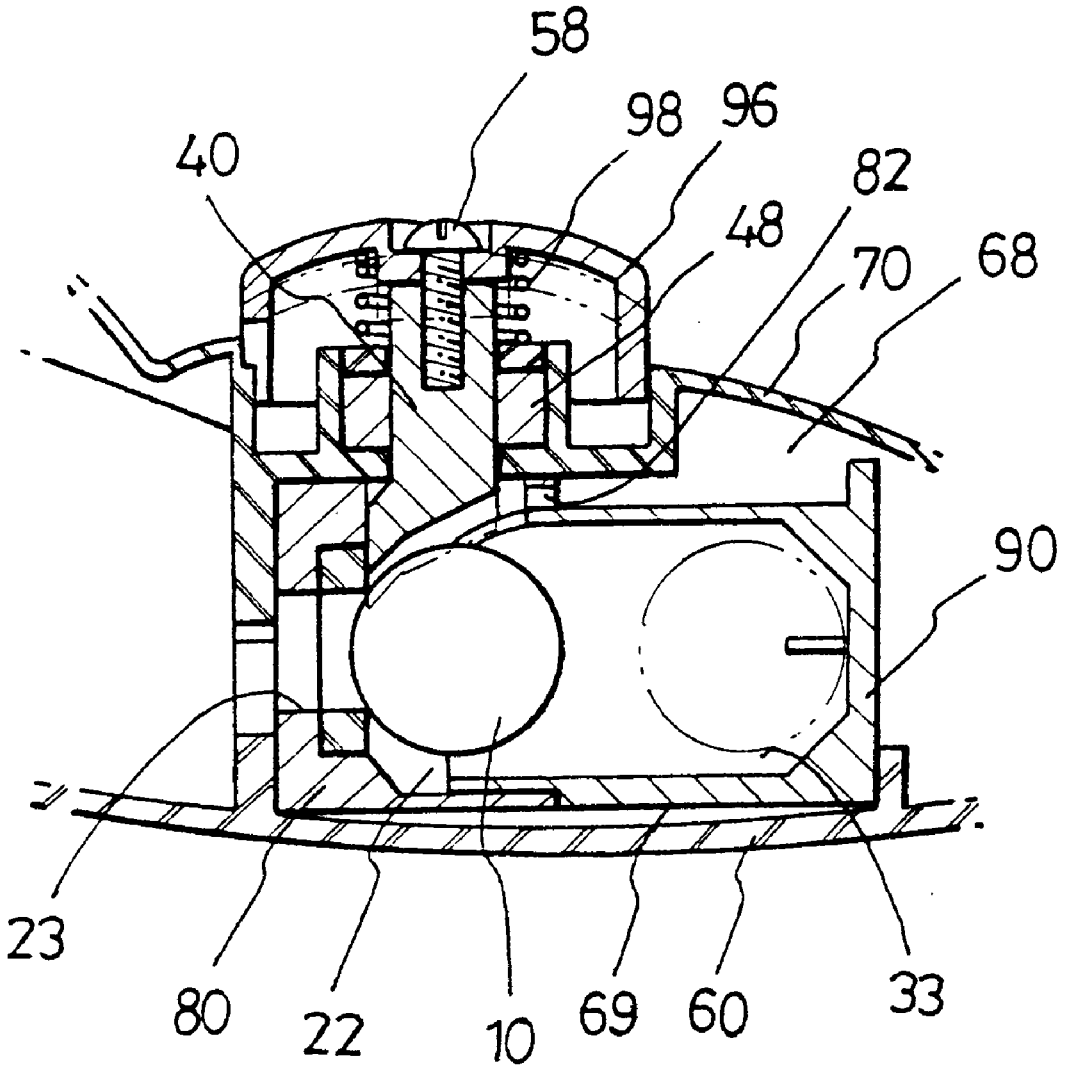
FIG. 8 is an assembled sectional view of FIG. 6.

FIGS. 6 to 8 show a shower head including a water saving mechanism according to a preferred embodiment of the present invention. In construction, the shower head including the water saving mechanism includes: a first head body 60 having a connecting part 62 connected to a shower hose 4 on the one end portion thereof and having a passage 68 and an assembling space 69 in the interior thereof; a second head body 70 adapted to be assembled with the first head body 60 and having a plurality of spray holes 72 formed on the end portion opposite to the connecting part 62 of the first head body 60; a ball valve 10 taking a ball shape; a body 80 adapted to be inserted into the assembling space 69 formed by means of the first and second head bodies 60 and 70 and having a valve space 22 into which the ball valve 10 is inserted and having an exit hole 23 on the one side thereof, the exit hole 23 having a smaller diameter than the ball valve 10; a ball valve moving member 90 adapted to be coupled to the valve space 22 in the direction opposite to the exit hole 23 of the body 80 and having a moving hole 33 into which the ball valve 10 is movably inserted on the interior thereof to thereby limit the moving range of the ball valve 10; and an operating member 40 adapted to be assembled to be movable forwardly/backwardly in a radial direction of the exit hole 23 of the body 80 on the one side of the peripheral surface of the body 80 and by passing the first head body 60 or the second head body 70 and for moving the ball valve 10 towards the ball valve moving member 90 by the advancement to the exit hole 23 of the body 80.

The shower head including the water saving mechanism according to the present invention further comprises a push member 96, as shown in FIGS. 6 to 8, which is installed to be movable forwardly/backwardly in a moving direction of the operating member 40, on the outer peripheral surface of the second head body 70 and is securely connected to the end portion of the outside of the operating member 40.

The shower head including the water saving mechanism according to the present invention further comprises an elastic member 98, as shown in FIGS. 6 to 8, which is installed between the push member 96 and the second head body 70 and applies an elastic force in a reverse direction to the push member 96 and/or the operating member 40.

Hereinafter, the same reference numerals of the shower head including a water saving mechanism of the present invention as those of the water saving mechanism for the shower device of the present invention illustrate the same components, an explanation of which will be avoided for the brevity of description.

The body 80 is provided with an operating hole 84 into which the operating member 40 is inserted and moved.

The second head body 70 is provided with an assembling hole 74 into which a supporting body 44 of the operating member 40 is inserted.

On the outside of the second head body 70, is formed a push groove 76 which is connected to the assembling hole 74 and is movably coupled to the push member 96.

Preferably, the elastic member 98 is formed by a coil spring.

Of course, the elastic member 98 may be formed by a plate spring or any type of elastic body which can apply an elastic force in a reverse direction to the push member 96 and/or the operating member 40.

Referring to the assembling process of the operating member 40 to the second head body 70, the supporting body 44 of the operating member 40 is inserted into the assembling hole 74 of the second head body 70, and a packing 48 is inserted into the supporting body 44 of the operating member 40 on the push groove 76 of the second head body 70. Next, a fixed plate 78 is fixed on the second head body 70 through the push groove 76 and a set screw 79, to thereby limit the deviation of the packing 48.

Thereby, the elastic member 98 is inserted over the supporting body 44 of the operating member 40, and the set screw 58 is screw-coupled to female screw threads 45 of the supporting body 44, on the outside of the push member 96. As a result, the operating member 40 is fixed to be integrated with the push member 96.

The body 80 is provided with an inlet hole 82 which is adapted to be connected to the interior of the first head body 60 and the second head body 70, to guide the water supplied through the shower hose 4 to the valve space 22.

The body 80 is fitted and fixedly assembled into the assembling space 69 in the interior of the first head body 60.

The passage 68 is formed between the external surface of the ball valve moving member 90 and the internal surfaces of the first head body 60 and the second head body 70, to have a predetermined interval along which the water is moved.

The inlet hole 82 is adapted to be connected to the passage 68.

On the other hand, an operation of the shower head including the water saving mechanism according to the preferred embodiment of the present invention is the same as that of the water saving mechanism for the shower device according to the present invention, an explanation of which will be avoided.

As apparent from the foregoing, the water saving mechanism for the shower device and the shower head including the water saving mechanism according to the preferred embodiments of the present invention can stop the supply of water by placing the shower head in a downward direction under the activation of a ball valve, without any operation of the valve handle grip of the tap, if the supply of water is to be stopped, and can resume the supply of water by pressing the push member, whereby it can exhibit an excellent water saving and a convenient operation system.

Moreover, the water saving mechanism for the shower device and the shower head including the water saving mechanism according to the preferred embodiments of the present invention have the following advantages: firstly, it can be constructed in a simple manner; secondly, it can be manufactured at low cost; thirdly, it can be assembled in a ready manner; fourthly, it can be trouble-free; and finally, it can be easily exchanged upon damage or breakdown.

On the other hand, the water saving mechanism for the shower device according to the preferred embodiment of the present invention can be applicable to be connected between the shower head and the shower hose in case of the existing shower device, and the shower head including the water saving mechanism can be applicable in case of a shower device newly manufactured.

It will be apparent to those skilled in the art that various modifications and variations can be made in a water saving mechanism for a shower device of the present invention without departing from the spirit or scope of the invention. Thus, it is intended that the present invention cover the modifications and variations of this invention provided they come within the scope of the appended claims and their equivalents.

What is claimed is:

1. A water saving mechanism for a shower device, comprising:

a ball valve having a ball element;

a body having a valve space into which said ball element is inserted and having an entrance hole on one side thereof and an exit hole on the opposite side thereof, said exit hole having a smaller diameter than said ball element thereby defining a valve seat;

a ball element moving chamber disposed in alignment with said valve space and extending in a direction between said entrance and exit holes of said body wherein said ball element is moveable therein to thereby limit the moving range of said ball element;

an operating member connected to and movable forwardly/backwardly in a radial direction on said body adjacent said exit hole for moving said ball element towards said ball element moving chamber by the advancement thereof toward said exit hole of said body; and said body having an interior surface and said chamber having an exterior surface, said surfaces defining a flow path around said chamber from said entrance hole to said exit hole.

2. The mechanism as defined in claim 1, wherein said flow path comprises one or more guide grooves which serve to guide the water flowing to said valve space of said body.

3. The mechanism as defined in claim 1, wherein said interior of said ball element moving chamber is inclined to smoothly move said ball element in a horizontal state to said exit hole of said body, by tare of said ball element.

4. The mechanism as defined in claim 1, wherein said operating member comprises an operating body having an inclined surface contacted with said ball element, and a supporting body adapted to be connected with said operating body and extended to the outside of said operating body.

5. The mechanism as defined in claim 1, further comprising:

a push member connected to and moveable with said operating member and extending on an outer peripheral surface of said body; and an elastic member adapted to be installed between said push member and said body for applying an elastic force in a reverse direction to said push member and said operating member.

6. The mechanism as defined in claim 5, wherein said operating member is provided with a supporting body extending through an operating hole in said body having the valve space and a packing disposed around said supporting body to seal the clearance formed between said body having the valve space and said operating hole to thereby prevent the water in said valve space from being leaked to the outside.

7. A shower head including a water saving mechanism, comprising:

a first head body having a connecting part connected to a shower hose on one end portion thereof;

a second head body assembled to said first head body so as to define an interior passage and assembling space, said second head body having a plurality of spray holes formed on an end portion opposite to said one end portion of said first head body;

a ball valve having a ball element;

a valve body disposed in said assembling space and defining a valve space into which said ball element is inserted and having an entrance hole on one side thereof and an exit hole on the opposite side thereof, said exit hole having a smaller diameter than said ball element thereby defining a valve seat;

a ball element moving chamber disposed in alignment with said valve space and extending in a direction between said entrance and exit holes of said valve body wherein said ball element is movable therein to thereby limit the moving range of said ball element; and an operating member connected to and movable forwardly/backwardly in a radial direction on said second head body and extending into said valve body adjacent said exit hole so as to move said ball element towards said ball element a moving chamber by the advancement thereof toward said exit hole of said valve body.

8. The shower head as defined in claim 7, further comprising:

a push member connected to and moveable with said operating member and extending on an outer peripheral surface of said second head body; and an elastic member adapted to be installed between said push member and said second head body for applying an elastic force in a reverse direction to said push member and said operating member.

9. The shower head as defined in claim 7, wherein said entrance hole opens into said interior passage and assembling space to guide the water supplied through said shower hose to said valve space.

* * * * *